US011072485B2

(12) United States Patent
Spivey et al.

(10) Patent No.: US 11,072,485 B2
(45) Date of Patent: Jul. 27, 2021

(54) INSULATED, MULTI-SIZE VESSEL CONTAINER

(71) Applicant: Base Brands, LLC, Atlanta, GA (US)

(72) Inventors: Patrick Spivey, Atlanta, GA (US); Kenneth Kreafle, Atlanta, GA (US)

(73) Assignee: Base Brands, LLC, Atlanta, GA (US)

( * ) Notice: Subject to any disclaimer, the term of this patent is extended or adjusted under 35 U.S.C. 154(b) by 0 days.

(21) Appl. No.: 15/641,924

(22) Filed: Jul. 5, 2017

(65) Prior Publication Data

US 2019/0009972 A1 Jan. 10, 2019

(51) Int. Cl.

| | |
|---|---|
| ***B65D 81/38*** | (2006.01) |
| ***A47G 23/02*** | (2006.01) |
| ***B65D 43/02*** | (2006.01) |

(52) U.S. Cl.

CPC ..... *B65D 81/3876* (2013.01); *A47G 23/0241* (2013.01); *B65D 43/0229* (2013.01); *A47G 2023/0275* (2013.01); *B65D 2543/0049* (2013.01)

(58) Field of Classification Search

CPC ..... B65D 81/3876; A47G 2023/0241; A47G 23/0241; A45F 5/00

USPC ... 220/592.27, 592.17, 592.16, 23.87, 23.89, 220/229; 206/459.5; 224/148

See application file for complete search history.

(56) References Cited

U.S. PATENT DOCUMENTS

| | | | | |
|---|---|---|---|---|
| 5,301,857 | A * | 4/1994 | Green | A45F 5/02 215/365 |
| 5,904,267 | A * | 5/1999 | Thompson | B65D 81/3879 215/12.1 |
| D433,225 | S | 11/2000 | Deiss | |
| 6,231,801 | B1 * | 5/2001 | Boutaghou | G11B 5/64 264/129 |
| 6,237,801 | B1 * | 5/2001 | Liu | A47G 19/22 220/592.17 |
| D596,500 | S | 7/2009 | Diss | |
| D627,601 | S | 11/2010 | Eyal | |
| D633,338 | S | 3/2011 | Rosbach | |
| 8,181,801 | B2 * | 5/2012 | Nuotio | B65D 47/2037 215/302 |
| D698,244 | S | 1/2014 | Lin | |
| D699,516 | S | 2/2014 | Kim | |
| D714,644 | S | 10/2014 | Wagner | |
| D724,385 | S | 3/2015 | Hurley | |

(Continued)

*Primary Examiner* — Anthony D Stashick
*Assistant Examiner* — Raven Collins
(74) *Attorney, Agent, or Firm* — Park, Vaughan, Fleming & Dowler LLP

(57) ABSTRACT

Embodiments of the present invention including an insulated, multi-size vessel container are described. In an embodiment, the container includes a body for receiving a vessel of various shapes and sizes. The container may further include a removable lid configured to engage an opening of the container, where the lid is configured to retain the vessel within the container. The lid may further include a collar for securely retaining the neck of the vessel so that the vessel remains firmly established in the container. The container may further include a body having a tapered or otherwise varying interior, such that vessels of various shapes and sizes can be retained within the body equally well. The container may further include a vacuum insulated layer that serves to maintain the temperature of the vessel's contents. Additional embodiments are described.

3 Claims, 5 Drawing Sheets

(56) References Cited

U.S. PATENT DOCUMENTS

| | | | | | |
|---|---|---|---|---|---|
| D724,894 | S | | 3/2015 | Brosius | |
| D753,442 | S | | 4/2016 | Weernink | |
| D765,471 | S | * | 9/2016 | Gorbold | D7/509 |
| D774,826 | S | | 12/2016 | Boroski | |
| D776,564 | S | | 1/2017 | Seth-Andersson | |
| D787,939 | S | | 5/2017 | Lam | |
| D790,624 | S | | 6/2017 | Matsushita | |
| D798,110 | S | * | 9/2017 | Valenti | D7/507 |
| D802,365 | S | | 11/2017 | Yao | |
| D803,064 | S | | 11/2017 | Marina | |
| 9,988,202 | B2 | * | 6/2018 | Haas | A47G 23/0241 |
| 2012/0292219 | A1 | * | 11/2012 | Terwilliger | B65D 51/002 206/459.5 |
| 2013/0327738 | A1 | * | 12/2013 | Harrison | A61J 9/001 215/44 |
| 2017/0137207 | A1 | * | 5/2017 | Mackintosh | B65D 81/3881 |
| 2018/0043731 | A1 | * | 2/2018 | Cheng | B25F 1/00 |

* cited by examiner

INSULATED, MULTI-SIZE VESSEL CONTAINER

FIELD

This disclosure relates generally to containers for retaining vessels, and more specifically to an insulated container for retaining vessels of various sizes.

BACKGROUND

Various vessels for retaining liquids are known. Of particular interest here, but by no means is the present invention limited thereto, are vessels for containing wine. Wine vessels, or bottles, come in various shapes and sizes and are known as poor insulators. In other words, wine bottles do a poor good job of keeping their contents cold or at a set, steady temperature. In order to keep a wine bottle cold, for example, it typically is placed in a refrigerator, a cooler, an ice bucket, or some other receptacle designed to keep its contents cold. The wine also could be transferred to (or emptied into) another container that does a better job of maintaining its desired temperature.

The inconvenience and hazards of keeping a vessel's contents at a cool or otherwise steady temperature are well known. For example, keeping the vessel in a refrigerator or other cooler can be inconvenient since it requires that the vessel be placed out of the immediate reach of its owner/user. Likewise, keeping the vessel on ice is both inconvenient and messy since it requires access to and a constant supply of ice, as well as the mess that results from melting ice and water dripping from the vessel as it is used. Likewise, transferring the vessel's contents to a more insulated vessel can result in spillage. And, since vessels come in various shapes and sizes, insulated containers for housing the vessel itself often may not suitably house the vessel due to a mismatch between the size and shape of the insulated container versus the size and shape of the vessel.

SUMMARY

Embodiments of the present invention including an insulated, multi-size vessel container are described. In an embodiment, the container includes a body for receiving a vessel of various shapes and sizes. The container may further include a removable lid configured to engage an opening of the container, where the lid is configured to retain the vessel within the container. The lid may further include a collar for securely retaining the neck of the vessel so that the vessel remains firmly established in the container. The container may further include a body having a tapered or otherwise varying interior, such that vessels of various shapes and sizes can be retained within the body equally well. The container may further include a vacuum insulated layer that serves to maintain the temperature of the vessel's contents. These and other embodiments of the present invention will be described in more detail below in connection with the accompanying drawings and claims.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

DETAILED DESCRIPTION

Various features and advantageous details are explained more fully with reference to the non-limiting embodiments that are illustrated in the accompanying drawings and detailed in the following description. Descriptions of well-known starting materials, processing techniques, components, and equipment are omitted so as not to unnecessarily obscure the invention in detail. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure.

Figure 1:
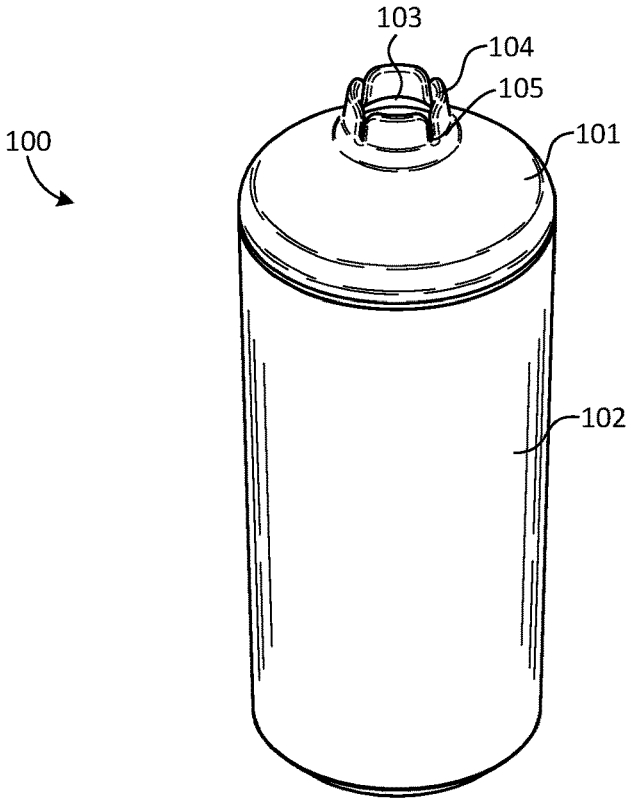
FIG. 1 is a top perspective view diagram of one embodiment of an insulated, multi-size vessel container.

FIG. 1 is a top perspective view diagram of one embodiment of an insulated, multi-size vessel container 100. In this embodiment, container 100 includes lid 101 and body 102. Lid 101 has an opening 103 through which the upper end (or neck) of a vessel (not shown) extends. In an embodiment, lid 101 is removable from body 102 by means known to those skilled in the art, such as via a threaded, snap-on, or other connection. In another embodiment, lid 101, and in particular the portion of lid 101 that forms opening 103, can be formed by a pliable material that exhibits some "stretch" around the upper end (or neck) of a vessel housed by the container. In this particular embodiment, the firm (or snug) fitting between the portion of lid 101 that forms opening 103 and the upper end (or neck) of a vessel housed by the container causes the vessel to remain substantially stationary or affixed in the container, while also supplying a substantially airtight barrier between the inside and outside of the container. This substantially airtight barrier assists in maintaining the temperature of the vessel's contents. As also shown in this particular embodiment and/or as a separate embodiment, the portion of lid 101 that forms opening 103 can include a collar having one or more raised members 104 that add support and stability to the container's effort to securely retain the upper end (or neck) of a vessel housed by container 100. In still another embodiment, the raised member 104 can include one or more slots 105 in the member 104 to better enable the lid to receive the upper end (or neck) of a vessel housed by the container.

Figure 2:
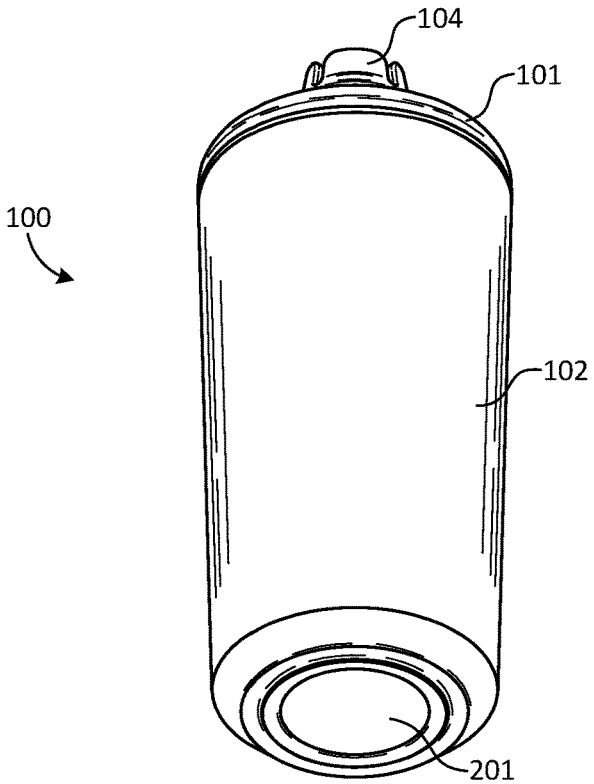
FIG. 2 is a bottom perspective view diagram of one embodiment of an insulated, multi-size vessel container.

FIG. 2 is a bottom perspective view diagram of an embodiment of an insulated, multi-size vessel container 100. The embodiment of FIG. 2 shows bottom 201 of container 100. Various embodiments of bottom 201 are within the scope of the present invention. For example, bottom 201 can be formed integrally with container 100. Likewise, bottom 201 can be removable from container 100. The removable nature of bottom 201 can be accomplished through means known to those skilled in the art, such as via a threaded, snap-on, or other connection. In this manner, a vessel housed by container 100 may be inserted either through the top of container 100 (when lid 101 is removed) or through the bottom of container 100 (when bottom 201) is removed. Whether a vessel is inserted into container 100 through the top or bottom of container 100 may depend on the size and/or shape of the vessel, as described in more detail below.

Figure 3:
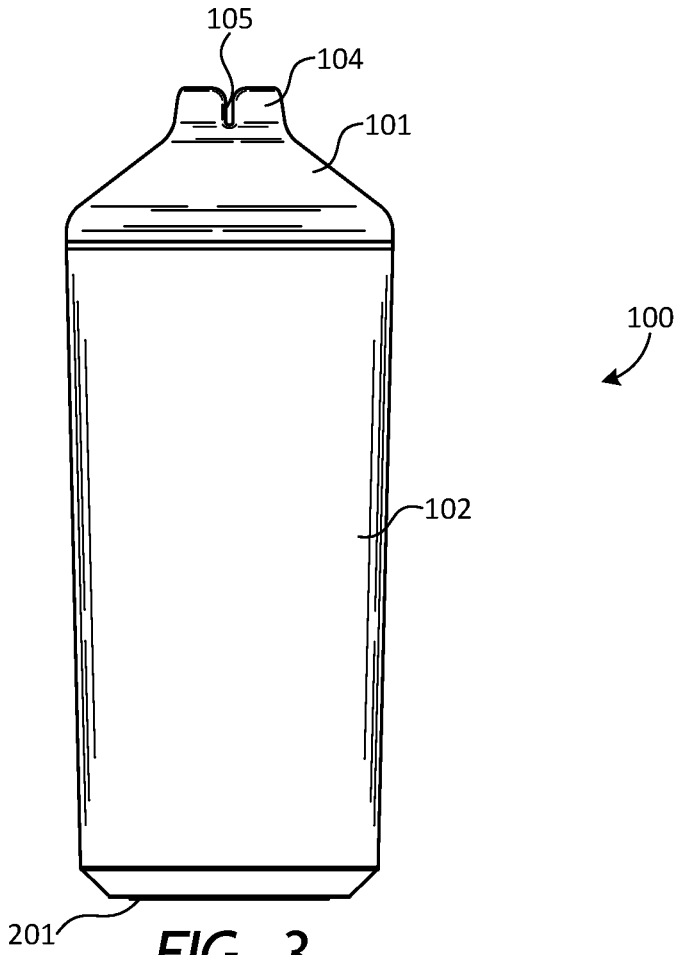
FIG. 3 is a side view diagram of one embodiment of an insulated, multi-size vessel container.

FIG. 3 is a side view diagram of an embodiment of an insulated, multi-size vessel container 100. This embodiment further illustrates lid 101, body 102, raised member 104, slot 105, and bottom 201.

Figure 4:
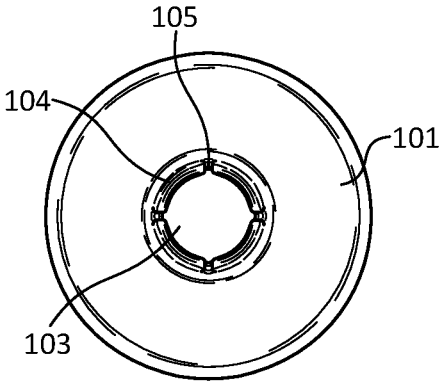
FIG. 4 is a top view diagram of one embodiment of an insulated, multi-size vessel container.

FIG. 4 is a top view diagram of an embodiment of an insulated, multi-size vessel container 100. This embodiment further illustrates lid 101, opening 103, raised member 104, and slot 105. While four slots 105 are depicted, more or less slots are within the scope of the present invention.

Figure 5:
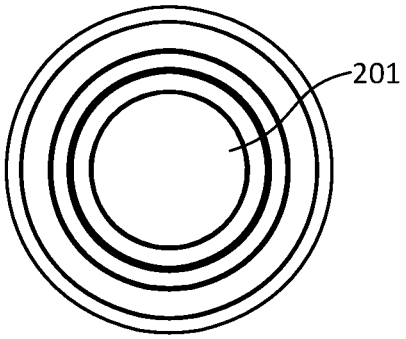
FIG. 5 is a bottom view diagram of one embodiment of an insulated, multi-size vessel container.

FIG. 5 is a bottom view diagram of an embodiment of an insulated, multi-size vessel container 100. This embodiment further illustrates bottom 201. While bottom 201 is depicted in this particular embodiment as the centermost portion of the bottom of container 100, it should be appreciated that the invention is not limited to that embodiment. For example, bottom 201 could extend to any of the concentric rings depicted in FIG. 5 and beyond. In other words, depending on the embodiment, the "bottom" 201 of container 100 could even be considered to extend up the lower, outside portion of container 100. As explained above, bottom 201 can be removable from container 100. The removable nature of bottom 201 can be accomplished through means known to those skilled in the art, such as via a threaded, snap-on, or other connection. Whether bottom 201 is removable or not, in another embodiment bottom 201 can include a layer that creates friction between the bottom (or portion thereof) and the surface container 100 sit on so as to prevent container 100 from sliding across the surface and, thereby, potentially spilling or otherwise falling off the surface.

Figure 6:
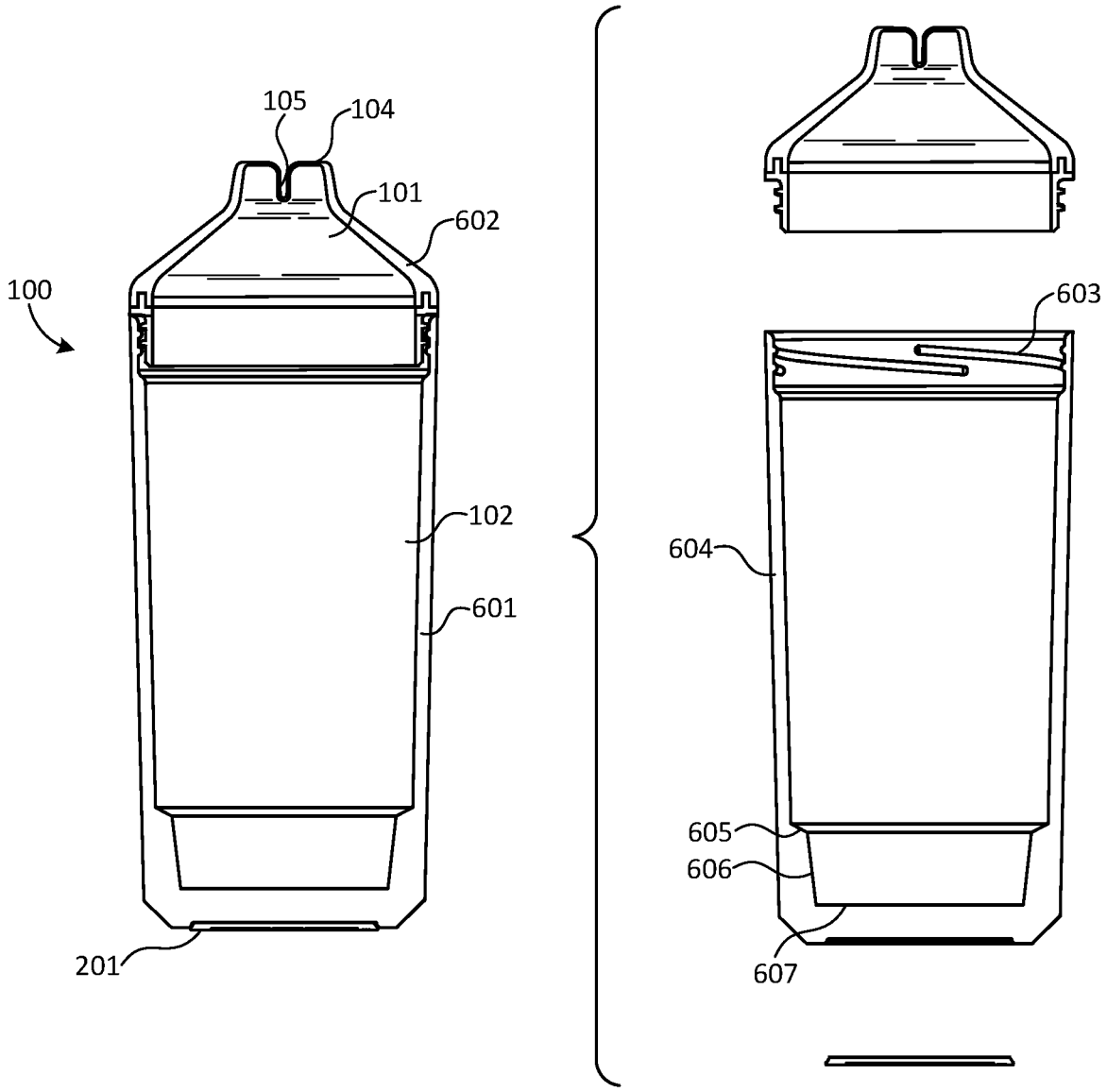
FIG. 6 is an exploded, cross-sectional view of one embodiment of an insulated, multi-size vessel container.
Figure 9:
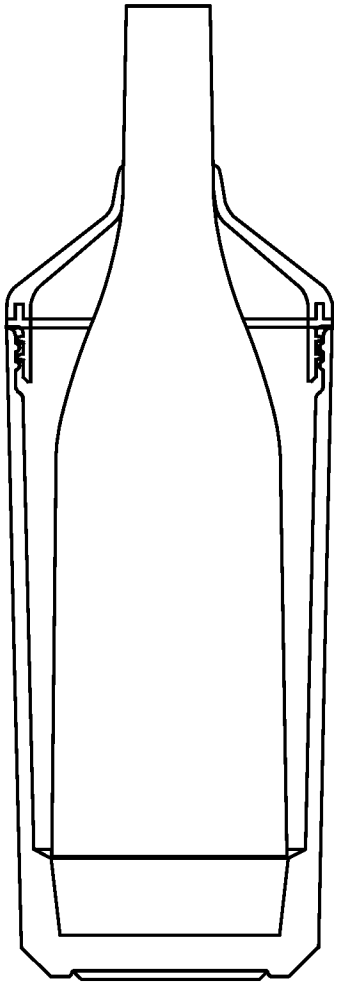
FIG. 9 is a cross-sectional view of one embodiment of an insulated, multi-size vessel container containing a vessel of a certain size and shape.
Figure 8:
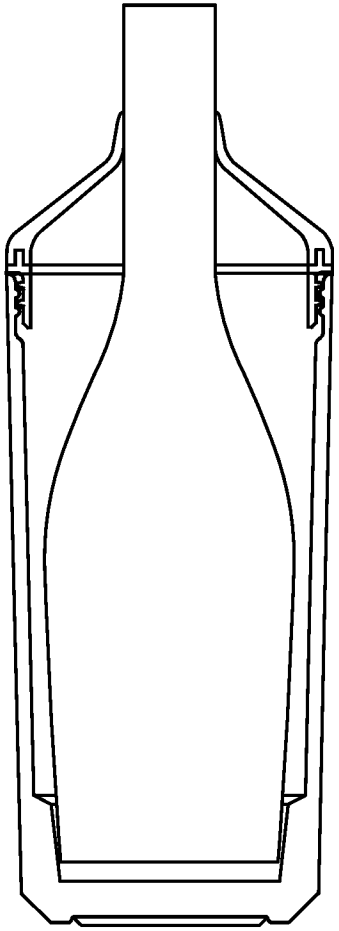
FIG. 8 is a cross-sectional view of one embodiment of an insulated, multi-size vessel container containing a vessel of a certain size and shape.
Figure 7:
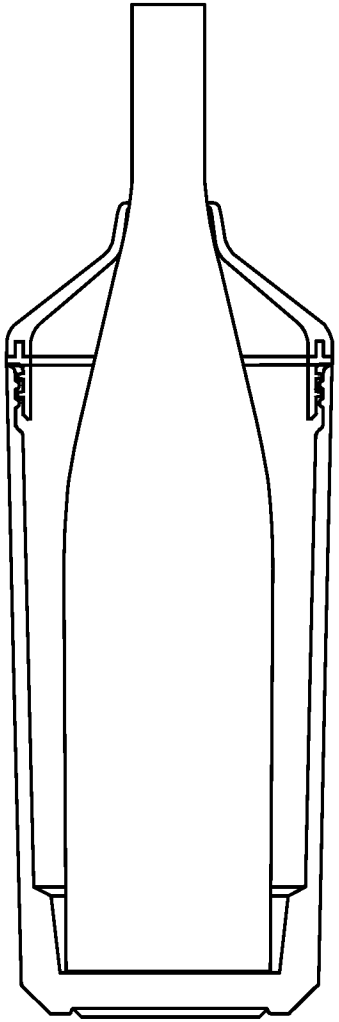
FIG. 7 is a cross-sectional view of one embodiment of an insulated, multi-size vessel container containing a vessel of a certain size and shape.
Figure 12:
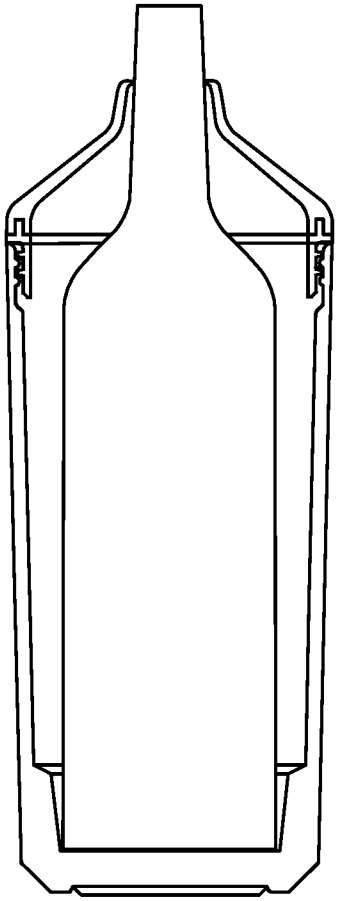
FIG. 12 is a cross-sectional view of one embodiment of an insulated, multi-size vessel container containing a vessel of a certain size and shape.
Figure 11:
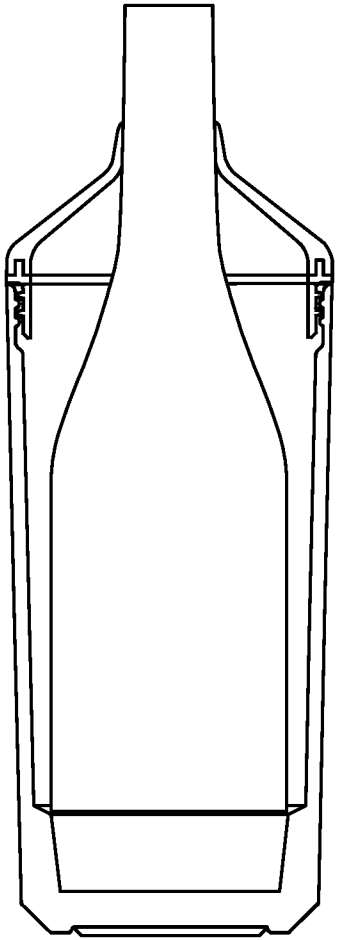
FIG. 11 is a cross-sectional view of one embodiment of an insulated, multi-size vessel container containing a vessel of a certain size and shape.
Figure 10:
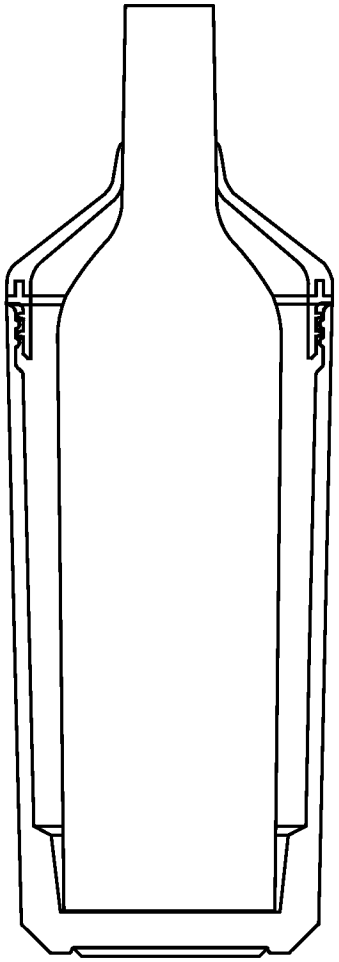
FIG. 10 is a cross-sectional view of one embodiment of an insulated, multi-size vessel container containing a vessel of a certain size and shape.

FIG. 6 is an exploded, cross-sectional view of one embodiment of an insulated, multi-size vessel container 100. This embodiment shows lid 101, body 102, raised member 104, and slot 105. This embodiment also illustrates body 102 and lid 101 being vacuum insulated via notations 601 and 602, respectively. This vacuum insulation serves to better maintain the temperature of any liquid contained in a vessel housed by container 100. While this embodiment shows both body 102 and lid 101 as being vacuum insulated, it should be appreciated that one, both, or none of those components may be vacuum insulated and still be within the scope of the present invention.

The embodiment of FIG. 6 also shows lid 101 being connected to body 102 via threaded connection 603. As explained above, other connections are known by those skilled in the art and are, therefore, within the scope of the present invention. In another embodiment, FIG. 6 shows that the inside diameter of body 102 is tapered, or otherwise changes, along or at surfaces 604, 605, and 606. As described in more detail below in connection with FIGS. 7-12, this changing inside diameter allows container 100 to more securely house vessels of various sizes and shapes.

As will be appreciated by those skilled in the art, vessels come in a variety of shapes and sizes. As one example only, wine bottles typically have a volume of 750 mL, but come in a variety of bottle shapes and sizes. Some of these shapes and sizes are depicted in FIGS. 7-12. As shown in those FIGS., the varying inside diameter of body 102 accommodates these varying shapes and sizes in a manner that both provides support for the vessel but also ensures that the neck of the vessel extends through opening 103 in lid 101. In this manner, a vessel of many shapes and sizes can be inserted into container 100, securely held therein, maintained at a substantially constant temperature (due in part to the vacuum sealed nature of body 102 and/or lid 101), and used to dispense its contents with or without removing the vessel from container 100.

Although the invention(s) is/are described herein with reference to specific embodiments, various modifications and changes can be made without departing from the scope of the present invention(s), as set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

The invention claimed is:

1. An apparatus for housing a vessel, comprising:

a body for receiving at least a portion of the vessel, wherein the body has an upper portion having a threaded connection and a first outside diameter;

a lid having a lower portion and an upper portion having a continuously solid outer surface wherein the lower portion has a threaded connection at a first outside diameter, and wherein the threaded connection on the lower portion of the lid engages with the threaded connection on the upper portion of the body to form a substantially airtight connection;

wherein the upper portion of the lid has a second outside diameter, where the second outside diameter is larger than the outside diameter of the lower portion of the lid, and the second outside diameter is equal to the outside diameter of the upper portion of the body;

the lid further including a collar tapering inwardly from the second outside diameter;

the lid further including an opening through which at least a portion of the vessel protrudes;

the collar formed by a plurality of pliable members extending above the opening in the lid, said pliable members having a slot therebetween for snugly fitting around the portion of the vessel protruding through the lid, whereby one or more pliable members help support the vessel in the apparatus;

the body having a lower interior portion having a first inside diameter and a second inside diameter such that the first and second inside diameters accommodate receiving vessels of various sizes and shapes, while allowing at least a portion of the vessel to protrude through the lid;

a bottom, whereby the lid and/or the bottom are removable for receiving the vessel into the apparatus;

the body further including a lower exterior portion having a first outside diameter, wherein the first outside diameter of the lower exterior portion of the body is equal to the first outside diameter of the upper portion of the body such that the body has no transition in contour between the first outside diameter of the upper portion of the body and the first outside diameter of the lower exterior portion of the body;

the lower exterior portion of the body further including a second outside diameter, wherein the second outside diameter of the lower exterior portion of the body is smaller than the first outside diameter of the lower exterior portion of the body such that the lower exterior portion of the body has a linear transition in contour between the first outside diameter of the lower exterior portion of the body and the second outside diameter of the lower exterior portion of the body;

the body being vacuum insulated such that the vacuum insulation is substantially the same between the first outside diameter of the upper portion of the body and the first inside diameter of the lower interior portion of the body;

the body consisting of a first material and the lid consisting of a second material, where the first material is different from the second material; and the body further including an interior flat bottom.

2. The apparatus of claim 1 further including an interface between the collar and the portion of the vessel that protrudes through the lid, wherein said interface is substantially airtight.

3. The apparatus of claim 2 further including a vessel.

* * * * *